US010982371B2

(12) United States Patent
Jeoung et al.

(10) Patent No.: US 10,982,371 B2
(45) Date of Patent: Apr. 20, 2021

(54) WASHING MACHINE

(71) Applicant: Samsung Electronics Co., Ltd., Suwon-si (KR)

(72) Inventors: Jeoung Kyo Jeoung, Yongin-si (KR); Boo Keun Yoon, Yongin-si (KR); Izumi Ikeda, Minoo (JP); Geun Kang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 9 days.

(21) Appl. No.: 16/319,172

(22) PCT Filed: May 31, 2017

(86) PCT No.: PCT/KR2017/005683
§ 371 (c)(1),
(2) Date: Jan. 18, 2019

(87) PCT Pub. No.: WO2018/016733
PCT Pub. Date: Jan. 25, 2018

(65) Prior Publication Data

US 2020/0149205 A1 May 14, 2020

(30) Foreign Application Priority Data

Jul. 18, 2016 (KR) ..... 10-2016-0091051

(51) Int. Cl.
*D06F 17/06* (2006.01)
*D06F 17/08* (2006.01)
(Continued)

(52) U.S. Cl.
CPC ..... *D06F 37/065* (2013.01); *D06F 17/06* (2013.01); *D06F 17/08* (2013.01); *D06F 23/02* (2013.01);
(Continued)

(58) Field of Classification Search
CPC ..... D06F 17/06; D06F 17/08; D06F 23/02; D06F 37/04; D06F 37/06; D06F 37/065; D06F 37/22; D06F 37/40
(Continued)

(56) References Cited

U.S. PATENT DOCUMENTS 9,080,279 B2 7/2015 Jun et al.
2004/0107739 A1 6/2004 Kim et al.
(Continued)

FOREIGN PATENT DOCUMENTS

CN 103668855 A 3/2014
CN 104040064 A 9/2014
(Continued)

OTHER PUBLICATIONS

ISA/KR, International Search Report and Written Opinion of the International Searching Authority, International Application No. PCT/KR2017/005683, dated Sep. 4, 2017, 9 pages.
(Continued)

*Primary Examiner* — Levon J Shahinian

(57) ABSTRACT

Disclosed herein is a washing machine. The washing machine includes a main body having a laundry inlet on a front surface portion of the main body, a tub provided inside the main body for storing washing water, a drum rotatably provided in the tub, a pulsator provided inside the drum and configured to be rotated separately from the drum, and a driving device configured to provide power to the drum and the pulsator, wherein no extra structure is mounted on the inner surface of the drum.

4 Claims, 7 Drawing Sheets

(51) Int. Cl.

| | |
|---|---|
| ***D06F 23/02*** | (2006.01) |
| ***D06F 37/04*** | (2006.01) |
| ***D06F 37/06*** | (2006.01) |
| ***D06F 37/22*** | (2006.01) |
| ***D06F 37/40*** | (2006.01) |

(52) U.S. Cl.
CPC ..... *D06F 37/04* (2013.01); *D06F 37/06* (2013.01); *D06F 37/22* (2013.01); *D06F 37/40* (2013.01)

(58) Field of Classification Search
USPC ..... 68/12.14, 24, 139, 140
See application file for complete search history.

(56) References Cited

U.S. PATENT DOCUMENTS

| | | | | |
|---|---|---|---|---|
| 2006/0016020 | A1* | 1/2006 | Park | D06F 39/083 8/158 |
| 2014/0190219 | A1 | 7/2014 | Kim et al. | |
| 2016/0244905 | A1 | 8/2016 | Lv et al. | |

FOREIGN PATENT DOCUMENTS

| | | | |
|---|---|---|---|
| FR | 1227699 | A | 8/1960 |
| JP | 2010046323 | A | 3/2010 |
| KR | 10-1999-0042133 | A | 6/1999 |
| KR | 10-2005-0087343 | A | 8/2005 |
| KR | 10-0984583 | B1 | 9/2010 |
| KR | 10-2016-0075614 | A | 6/2016 |
| WO | 2009062920 | A1 | 5/2009 |
| WO | 2011067287 | A1 | 6/2011 |
| WO | 2015009106 | A1 | 1/2015 |
| WO | 2015127823 | A1 | 9/2015 |
| WO | 2015158044 | A1 | 10/2015 |

OTHER PUBLICATIONS

European Patent Office, "Supplementary European Search Report," Application No. EP17831207, dated Jun. 14, 2019, 9 pages.

Office Action dated Aug. 27, 2020 in connection with Chinese Patent Application No. 201780043985.8, 19 pages.

* cited by examiner

WASHING MACHINE

CROSS-REFERENCE TO RELATED APPLICATIONS

This application is a 371 National Stage of International Application No. PCT/KR2017/005683, filed May 31, 2017, which claims priority to Korean Patent Application No. 10-2016-0091051, filed Jul. 18, 2016, the disclosures of which are herein incorporated by reference in their entirety.

BACKGROUND

1. Field

The present disclosure relates to a washing machine, and more particularly, to a washing machine capable of independently driving a drum and a pulsator.

2. Description of Related Art

A washing machine is a machine for washing clothes using electric power, and generally includes a tub for storing washing water and a drum rotatably installed inside the tub. The washing machine includes a drum type washing machine for washing the laundry by raising and lowering the laundry while the rotating tub is rotating, and an electric washing machine for washing the laundry using water flows generated by the pulsator when the rotating tub is rotated.

In the drum type washing machine, the rotating axis of the drum is arranged in a substantially horizontal direction, so that the laundry is lifted and dropped as the drum is rotated, thereby washing the laundry.

The conventional drum type washing machine includes a lifter provided inside the drum for lifting the laundry upward. Unlike the electric washing machine, the conventional drum type washing machine is not provided with a pulsator for generating water flows inside the drum.

SUMMARY

One aspect of the present disclosure discloses a drum type washing machine having no lifter but a pulsator.

Another aspect of the present disclosure discloses a drum type washing machine capable of independently driving a drum and a pulsator by adopting a dual drive motor.

Still another aspect of the present disclosure discloses a drum type washing machine capable of improving washing performance with a pulsator driven independently of a drum.

Yet another aspect of the present disclosure discloses a drum type washing machine capable of reducing washing time with improved washing performance by providing a pulsator driven independently of a drum.

In accordance with one aspect of the present disclosure, a washing machine includes a main body having a laundry inlet on a front surface portion of the main body, a tub provided inside the main body to store washing water, a drum rotatably provided in the tub, a pulsator disposed inside the drum and configured to be rotated separately from the drum, and a driving device configured to provide power to the drum and the pulsator, wherein no extra structure is mounted on an inner surface of the drum.

The drum may include a plurality of through holes continuously formed along a circumferential surface thereof.

The drum and the pulsator may have different rotating directions.

The driving device may include an annular stator, a first rotor rotating inside the stator, and a second rotor rotating outside the stator.

According to an aspect of the present disclosure, a washing machine may independently drive a drum and a pulsator using a dual drive motor, thereby improving washing performance and reducing washing time.

DETAILED DESCRIPTION

Figure 1:
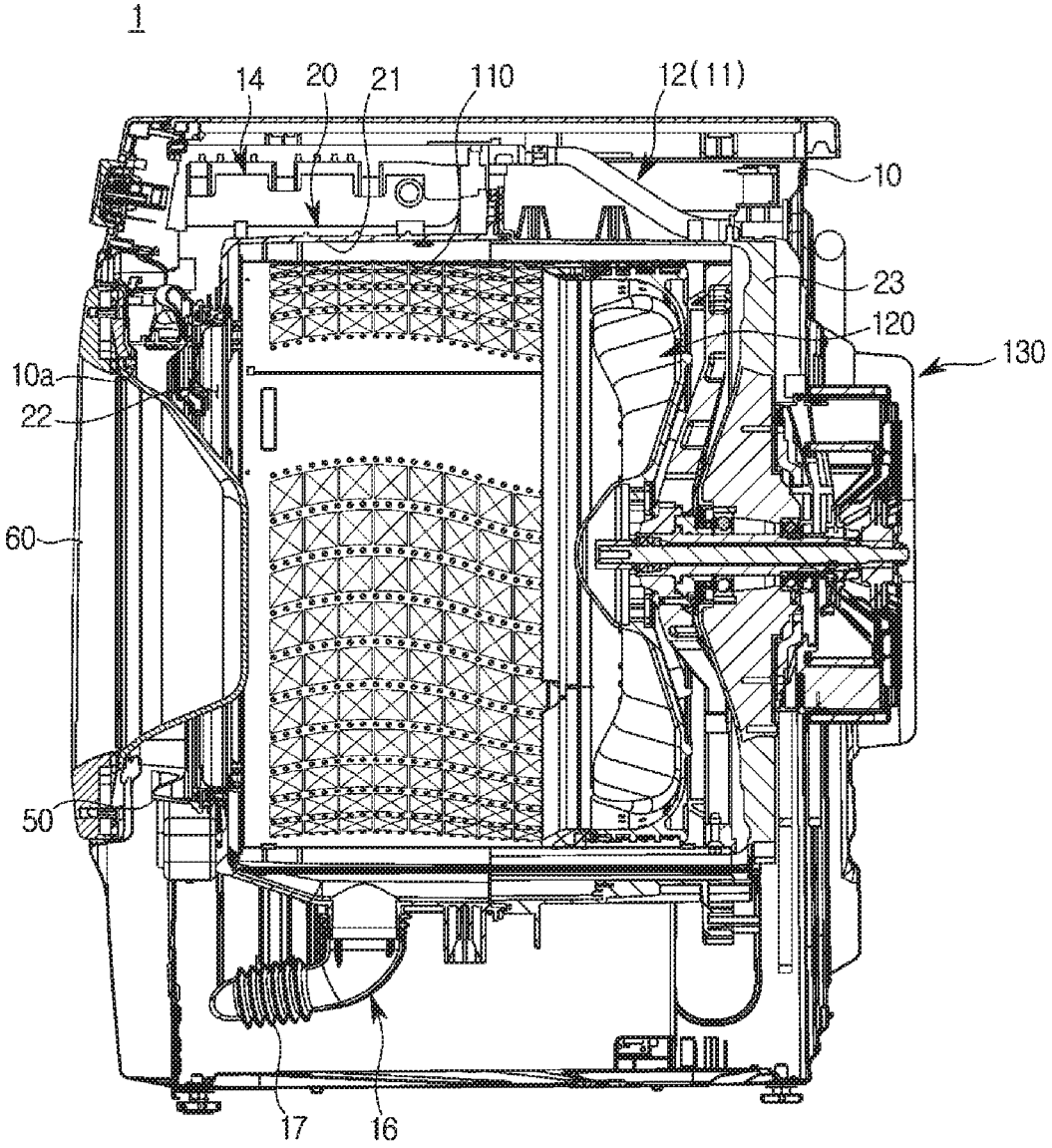
FIG. 1 is a lateral cross-sectional view illustrating a schematic configuration of a washing machine according to an embodiment of the present disclosure.

The descriptions proposed herein are just preferred examples for the purpose of illustration only so it should be understood that other equivalents and modifications could be made thereto without departing from the spirit and scope of the disclosure.

Also, like reference numerals or symbols provided in each of the drawings indicate components or elements performing the same functions.

Also, the terms used herein are merely to describe a specific embodiment, and do not limit the present disclosure. Further, unless the context clearly indicates otherwise, singular expressions should be interpreted to include plural expressions. It should be understood that the terms "comprises," "comprising," "includes" or "has" are intended to indicate the presence of features, numerals, steps, operations, elements and components described in the specification or the presence of combinations of these, and do not preclude the presence of one or more other features, numerals, steps, operations, elements and components, the presence of combinations of these, or additional possibilities.

Also, the terms including ordinal numbers such as "first," "second," etc. can be used to describe various components, but the components are not limited by those terms. The terms are used merely for the purpose of distinguishing one component from another. For example, a first component may be referred to as a second component, and similarly, a second component may be referred to as a first component without departing from the scope of the claims of the disclosure. The term "and/or" encompasses combinations of a plurality of items or any one of the plurality of items.

Meanwhile, the terms "front end", "rear end", "upper portion", "lower portion", "upper end" and "lower end" used in the following description are defined based on the drawing, but a shape and a location of each element are not limited by those terms.

Hereinafter, a front loading type washing machine for inputting laundry through the front of the washing machine will be described, but the present disclosure is not limited thereto and the present disclosure is also applicable to a top loading type washing machine in which laundry is loaded from above the washing machine.

Hereinafter, embodiments according to the present disclosure will be described in detail with reference to the accompanying drawings.

Figure 2:
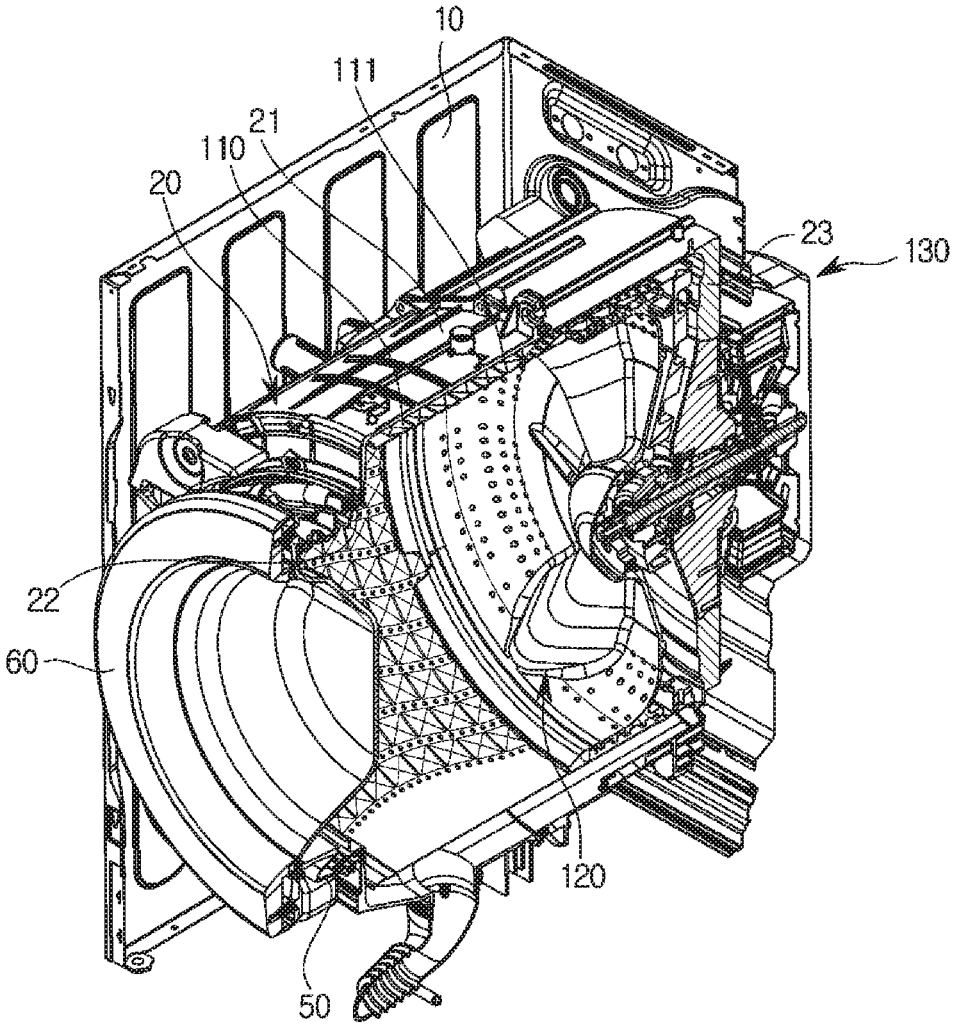
FIG. 2 is a view illustrating an inside of the washing machine shown in FIG. 1.

FIG. 1 is a lateral cross-sectional view illustrating a schematic configuration of a washing machine 1 according to an embodiment of the present disclosure. FIG. 2 is a view illustrating an inside of the washing machine 1 shown in FIG. 1.

Referring to FIG. 1, the washing machine 1 may include a main body 10 forming an outer appearance and containing various components, a tub 20 provided inside the main body 10 to store washing water, a drum 110 that receives and rotates laundry, a pulsator 120 rotatably disposed inside the drum 110, and a driving device 130 rotating the drum 110 and the pulsator 120.

The main body 10 may substantially have a box shape. The main body 10 may have a front plate, a rear plate, a top plate, a bottom plate, and side plates. The front plate may be provided with a laundry inlet 10*a* to allow laundry to be thrown into the drum 110.

The laundry inlet 10*a* of the main body 10 may be opened or closed by a door 60. The door 60 may be rotatably coupled to the main body 10 by a hinge member. The door 60 may be composed of a glass member and a door frame for supporting the glass member.

The glass member may be formed of a transparent tempered glass to be looked through to the inside of the main body 10. The glass member may be provided to protrude toward the inside of the tub 20 so as to prevent the laundry from being biased toward the door 60.

The tub 20 may store the washing water and may be formed in a substantially cylindrical shape. The tub 20 may be supported by a suspension. The tub 20 may include a hollow cylindrical portion 21, an opening 22 formed on one side of the cylindrical portion 21 to correspond to the laundry inlet 10*a* of the main body 10, and a bottom portion 23 formed on the other side of the cylindrical portion 21.

The laundry inlet 10*a* of the front plate of the main body 10 and the opening 22 of the tub 20 may be connected by a diaphragm 50. The diaphragm 50 forms a passage for connecting the laundry inlet 10*a* of the front plate of the main body 10 and the opening 22 of the tub 20, guides the laundry thrown into the laundry inlet 10*a* into the drum 110, and reduces transmission of vibration generated during rotation of the drum 110 to the main body 10.

The washing machine 1 according to an embodiment of the present disclosure may include a drainage device 16 capable of draining the washing water from the tub 20. The drainage device 16 may include a drain pipe 17 connected to the lower portion of the tub 20 to guide the washing water to the outside of the main body 10 and a drain pump for pumping the washing water of the tub 20.

A water supply device 11 for supplying washing water to the inside of the tub 20 may be provided at an upper portion of the tub 20. The water supply device 11 may include a water supply pipe 12 for supplying washing water from an external water supply source and a water supply valve for opening or closing the water supply pipe 12.

A detergent supply device 14 for supplying detergent to the tub 20 may be provided at an upper portion of the front side of the main body 10. The detergent supply device 14 may be connected to the tub 20 through a connecting pipe. The washing water supplied by the water supply pipe 12 may be supplied to the inside of the tub 20 together with the detergent by the detergent supply device 14.

Figure 3:
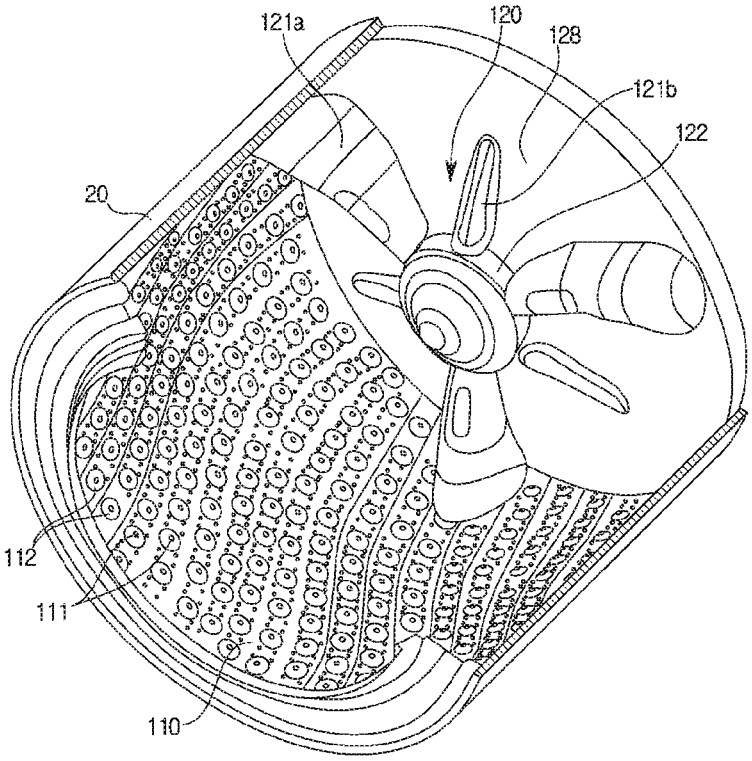
FIG. 3 is a view illustrating an inside of a tub, a drum, and a pulsator of a washing machine according to an embodiment of the present disclosure.
Figure 4:
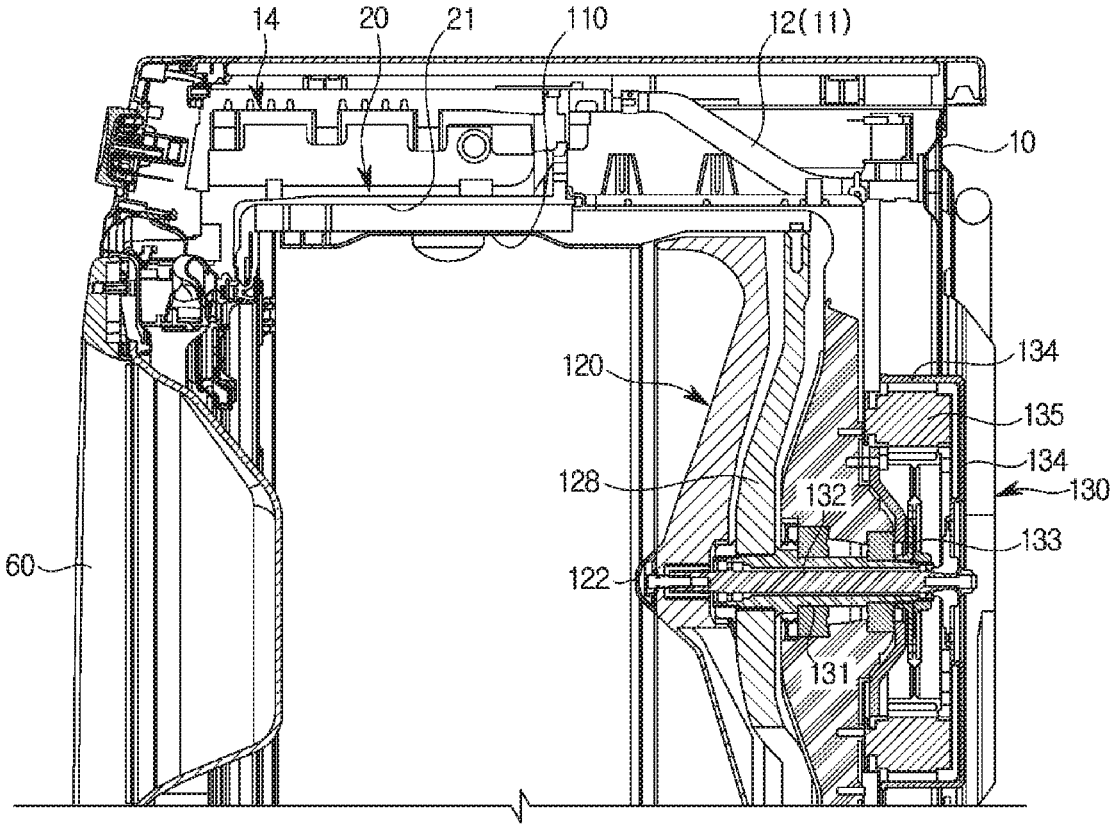
FIG. 4 is an enlarged view of a portion of the washing machine shown in FIG. 1.
Figure 5:
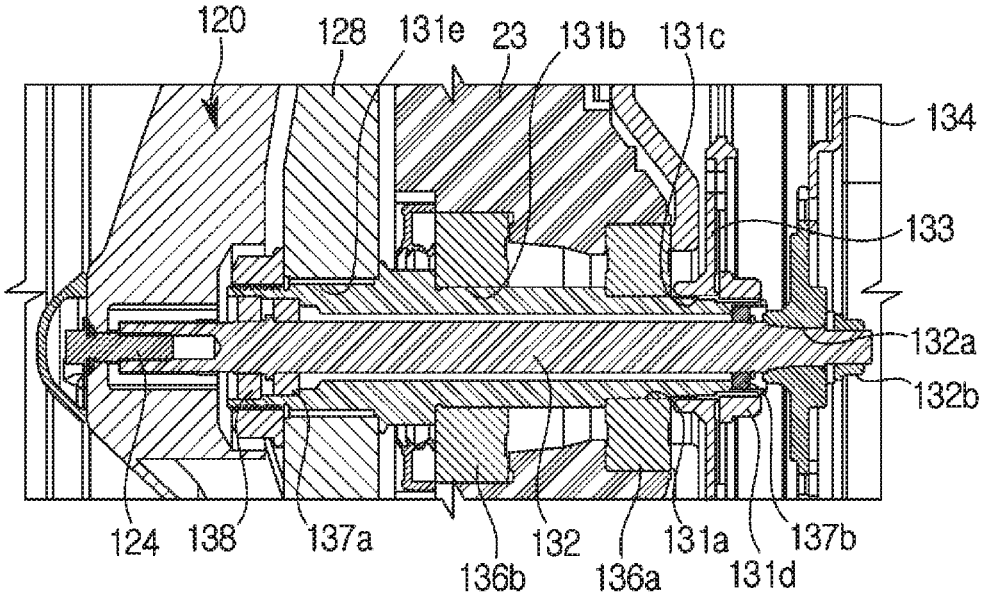
FIG. 5 is an enlarged view of a portion of the washing machine shown in FIG. 4.

FIG. 3 is a view illustrating an inside of the tub 20, the drum 110, and the pulsator 120 of the washing machine 1 according to an embodiment of the present disclosure. FIG. 4 is an enlarged view of a portion of the washing machine 1 shown in FIG. 1. FIG. 5 is an enlarged view of a portion of the washing machine 1 shown in FIG. 1. Through holes 111 of the drum 110 are not shown in FIG. 4.

The drum 110 has a substantially cylindrical shape with its front surface opened, and may be provided inside the tub 20. The drum 110 may be disposed such that its central axis is parallel to the center axis of the tub 20.

The drum 110 may rotate inside the tub 20. The drum 110 may perform washing by raising and lowering the laundry while rotating. Since the drum 110 in accordance with an embodiment of the present disclosure has no extra structure on its inner surface, it may secure a larger washing space.

Since the drum 110 of the washing machine 1 according to the embodiment of the present disclosure has no extra structure such as a lifter, it may have difficulty in raising the laundry when rotating at the same speed as the conventional washing machine. Therefore, the washing machine 1 according to the embodiment of the present disclosure may rotate at a speed higher than that of the conventional washing machine. For example, in the conventional washing machine, the drum rotates at 45 revolutions per minute (rpm), while the washing machine 1 according to the embodiment of the present disclosure may rotate the drum 110 at 70 to 80 rpm. That is, in the washing machine 1 according to the embodiment of the present disclosure, the drum 110 may be rotated to such an extent that the laundry is raised by the centrifugal force and then dropped.

There may be multiple through holes 111 formed along the circumference of the drum 110 to circulate the washing water stored in the tub 20. In an embodiment, the drum 110 of the washing machine 1 may have the multiple through holes 111 formed continuously along the circumferential face of the drum 110. In the conventional washing machine, the multiple through holes are not formed continuously along the circumferential face of the drum because a lifter is arranged in a portion of the inner circumferential face of the drum to lift the laundry. That is, the through holes are not formed in the portion where the lifter is arranged. On the contrary, the washing machine 1 in accordance with an embodiment of the present disclosure has the multiple through holes 111 formed along the circumferential face of the drum 110, allowing more washing water to be brought into the drum 110, thereby enhancing washing performance.

In addition, a protrusion 112 forming the through hole 111 may be formed to protrude inward from the drum 110. With this structure, the washing water may easily flow into the drum 110, but not easily flow out from the drum 110. Accordingly, the drum 110 of the washing machine 1 according to an embodiment of the present invention may be supplied with more washing water than in the conventional washing machine, thereby improving washing performance.

The drum 110 may be connected to the driving device 130, which will be described later, on the opposite side to a side facing the laundry inlet 10*a*.

The pulsator 120 is provided on the opposite side to the side facing the laundry inlet 10*a* of the drum 110 and may be configured to rotate independently of the drum 110. That is, the pulsator 120 may rotate in a direction different from the direction of rotation of the drum 110. The pulsator 120 may include a first blade 121*a*, a second blade 121*b*, and a coupling portion 122.

The first blade 121*a* may be larger than the second blade 121*b*. In the washing machine 1 according to the embodiment of the present disclosure, since the second blade 121*b* is provided in a smaller size than the first blade 121*a*, a wider washing space may be secured.

When viewed from the front where the door 60 is provided in FIG. 1, the washing machine 1 according to the embodiment of the present disclosure may also agitate the laundry in the front-back directions (hereinafter, such directions are referred to as a front-and-back direction) by the first blade 121*a* and the second blade 121*b* to prevent the laundry from sticking to the drum 110 as the drum 110 rotates at high speed as described above. In addition, since the drum 110 and the pulsator 120 are rotated in opposite directions during washing, the laundry may be more effectively agitated, thereby enhancing the washing performance.

The pulsator 120 may be connected to a second driving shaft 132, which will be described later and may rotate by receiving power from the driving device 130. Specifically, the coupling portion 122 of the pulsator 120 may be connected and fixed to the second driving shaft 132 by the coupling portion fixing member 124.

The driving device 130 may be provided behind the tub 20 to provide power for simultaneously or selectively rotating the drum 110 and the pulsator 120. The driving device 130 may include a first driving shaft 131 connected to the drum 110, the second driving shaft 132 rotatably disposed in the first driving shaft 131 and connected to the pulsator 120, a first rotor 133 connected to the first driving shaft 131, a second rotor 134 connected to the second driving shaft 132, and a stator 135 disposed with a gap between the first rotor 133 and the second rotor 134. The driving device 130 may convert the electric force to a mechanical rotational force. The driving device 130 may be a dual drive motor that may rotate the drum 110 and the pulsator 120, respectively.

The rotational force generated by the driving device 130 may be transmitted to the drum 110 through the first driving shaft 134 and may be transmitted to the pulsator 120 through the second driving shaft 135 provided inside the first driving shaft 134.

The first driving shaft 134 may be press-fitted into the first rotor 133, may rotate together with the first rotor 133, and may pass through the rear wall of the tub 20 to connect the drum 110 and the driving device 130.

A first bearing 136*a* and a second bearing 136*b* that rotatably support the first driving shaft 131 may be disposed on the outer circumferential surface of the first driving shaft 131 with a predetermined gap between them. The first bearing 136*a* and the second bearing 136*b* may be fixed to the tub 20.

The first driving shaft 131 may have a cylindrical shape so that the second driving shaft 132 may pass through. The first driving shaft 131 may include a first stepped portion 131*a* with the decreasing outer diameter to have the first bearing 136*a* mounted thereon without being moved in the vertical direction, and a second stepped portion 131*b* with the decreasing outer diameter to have the second bearing 136*b* mounted thereon without being moved in the vertical direction.

The first driving shaft 131 may have a first connecting portion 131*c* connected to the first rotor 133 at a lower side of a portion where the first bearing 136*a* is mounted, a first fixing nut 131*d* for fixing the first rotor 133 to the first driving shaft 131 may be fastened to the lower side of the first connecting portion 131*c*. The first driving shaft 131 may include a second connecting portion 131*e* formed on the upper side of a portion where the second bearing 136*b* is inserted, and connected to a flange member 128 that connects the first driving shaft 131 and the bottom of the drum 110 to transmit the rotational force of the first driving shaft 131 to the drum 110.

The first connecting portion 131*c* and the second connecting portion 131*e* may form a screw thread on the outer circumferential surface of the first driving shaft 131 and may be coupled with the first rotor 133 and the flange member 128, respectively, by screwing, but embodiments of the present disclosure are not limited thereto and the first connecting portion 131*c* and the second connecting portion 131*e* may have any structure as long as the structure may connect the first rotor 133 and the flange member 128 to the outer surface of the first driving shaft 131.

The second driving shaft 135 may be press-fitted into the second rotor 133 rotated together with the second rotor 133, and rotatably provided in the hollow interior of the first driving shaft 134. The second driving shaft 135 may pass through the rear wall of the tub 20 to connect the pulsator 120 and the driving device 130.

The second driving shaft 132 may have a third connecting portion 132*a* connected to the second rotor 134 by being drawn out from the lower end of the first driving shaft 131 at a lower portion of the second driving shaft 132, and a second fixing nut 132*b* may be fastened to the bottom end of the lower portion to prevent detachment of the second rotor 134.

The second driving shaft 132 may have a fourth connecting portion 132*c* connected to the pulsator 120 by being drawn from the upper end of the first driving shaft 131 at an upper portion of the second driving shaft 132.

The third connecting portion 132*a* and the fourth connecting portion 132*c* may form a screw thread on the outer circumferential surface of the second driving shaft 132 and be screwed with the second rotor 133 and the pulsator 120, respectively, but embodiments of the present disclosure are not limited thereto and the third connecting portion 132*a* and the fourth connecting portion 132*c* may have any structure as long as the structure may connect the second rotor 134 and the pulsator 120 to the outer surface of the second driving shaft 132.

A first sleeve bearing 137*a* and a second sleeve bearing 137*b* are fixed to the upper inner circumferential surface and the lower inner circumferential surface of the first driving shaft 131, respectively, and the second driving shaft 132 may be rotatably supported by the first sleeve bearing 137*a* and the second sleeve bearing 137*b*.

In addition, a sealing member 138 may be provided between the upper inner surface of the first driving shaft 131 and the upper outer surface of the second driving shaft 132 to prevent leakage of the washing water.

The first rotor 133 may include a first magnet 133*a* disposed to face the inner surface of the stator 135 with a predetermined gap. That is, the first magnet 133*a* is provided on the outer surface of the first rotor 133 and the inner surface of the first rotor 133 may be connected to the first connecting portion 131*c* of the first driving shaft 131. According to this configuration, the first rotor 133 may rotate inside the stator 135.

The second rotor 134 may include a second magnet 134*a* disposed to face the outer surface of the stator 135 with a predetermined gap. That is, the second magnet 134*a* may be provided on the outer surface of the second rotor 134, and the inner surface of the second rotor 134 may be connected to the third connecting portion 132*a* of the second driving shaft 132. According to this configuration, the second rotor 134 may rotate outside the stator 135.

The stator 135 may include a stator core formed in an annular shape, a bobbin which is a non-magnetic body wrapped around the stator core, a first coil wound on one side of the stator core, and a second coil wound on the other side of the stator core.

According to this configuration, in the washing machine 1 according to a embodiment of the present disclosure, the first power source may be applied to the first coil and the second power source may be applied to the second coil, and accordingly, only the first rotor 133 may be rotated when power is applied to only the first coil, only the second rotor 134 may be rotated when power is applied to only the second coil, and the first rotor 133 and the second rotor 134 may be simultaneously rotated when power is simultaneously applied to the first coil and the second coil.

Specifically, since the washing machine 1 according to an embodiment of the present disclosure may form a pair of independent magnetic circuits by forming a first magnetic circuit between one side of the stator 135 in which the first magnet 133*a* is disposed and the first rotor 133 and a second magnetic circuit between the other side of the stator 135 in which the second magnet 134*a* is disposed and the second rotor 134, the washing machine 1 may drive the first rotor 133 and the second rotor 134 separately.

Although, in the above description, the driving device 130 has two coils wound around one stator 135, the present disclosure is not limited to this and the driving device 130 may be configured to independently rotate the drum 110 and the pulsator 120 by controlling a power source applied through the inverter circuit while only one coil is wound around the stator 135.

Hereinafter, operation of the washing machine 1 according to an embodiment of the present invention will be described.

First, the washing machine 1 according to an embodiment of the present disclosure may apply power to the first coil and the second coil in opposite directions to rotate the drum 110 and the pulsator 120 in opposite directions during washing, causing the first rotor 133 and the second rotor 134 to be rotated in opposite directions to rotate the drum 110 and the pulsator 120 in opposite directions.

On the other hand, since the drum 110 and the pulsator 120 should be rotated at the same time during dehydration and rinsing, the washing machine 1 according to an embodiment of the present disclosure may rotate the first rotor 133 and the second rotor 134 in the same direction by simultaneously applying power to the first coil and the second coil, thereby rotating the drum 110 and the pulsator 120 in the same direction.

With the configuration, the washing machine 1 according to the embodiment of the present disclosure may agitate the laundry even if the drum 110 does not have a lifter, and rather improve the washing performance by using the pulsator 120 and the dual drive motor. In addition, since the washing machine 1 omits a structure such as a lifter, a washing space may also be secured. Further with the improved washing performance, washing time may be reduced.

Figure 6:
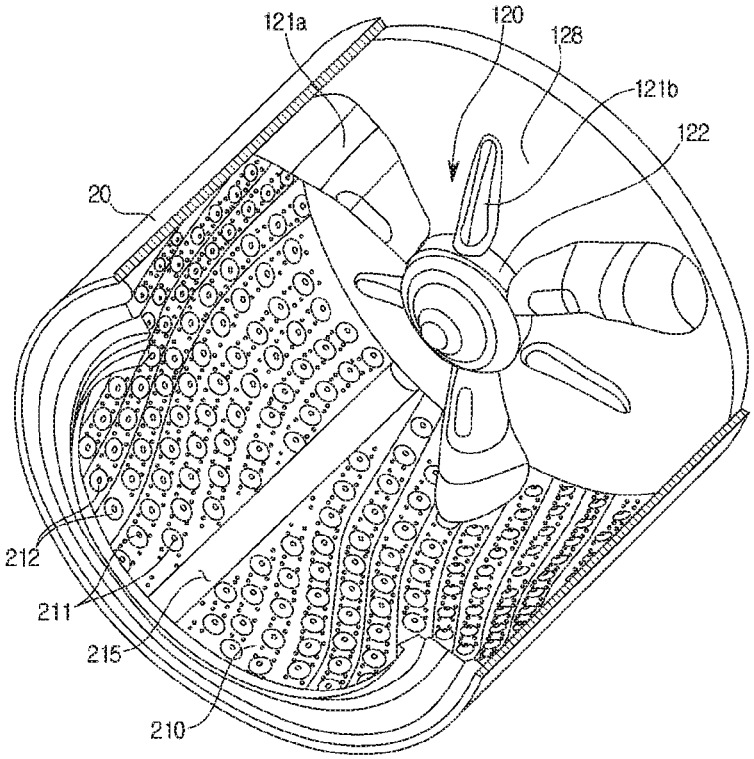
FIG. 6 is a view illustrating an inside of a tub, a drum, and a pulsator according to another embodiment of the present disclosure.

FIG. 6 is a view illustrating an inside of the tub 20, a drum 210, and the pulsator 120 according to another embodiment of the present disclosure.

The drum 210 according to another embodiment will be described with reference to FIG. 6. The same components as those in the embodiment shown in FIGS. 1 to 5 are denoted by the same reference numerals and the description thereof will not be repeated.

Referring to FIG. 6, the drum 210 according to another embodiment of the present disclosure may include a agitating groove 215 extending in the front-rear direction on the inner circumferential surface of the drum 210 and sunken toward the tub 20 from the inner circumferential surface of the drum 210. In FIG. 6, the agitating groove 215 extends continuously from the front end to the rear end in the front-rear direction of the drum 210, but the present disclosure is not limited thereto and the agitating groove 215 may be provided at a portion along the longitudinal direction of the drum 210.

Specifically, the through holes 211 formed in some portions of the inner circumferential surface of the drum 210 and the protrusions 212 forming the through holes 211 may be omitted in the drum 210, and the agitating groove 215 may be formed in the portion where the through holes 211 and the protrusions 212 are omitted. The number of the agitating grooves 215 may be three, but the number of the agitating groove 215 is not limited thereto.

Since the drum 210 according to an embodiment of the present disclosure includes the agitating groove 215, the laundry may be more effectively lifted and dropped, and a wider washing space may be secured.

Figure 7:
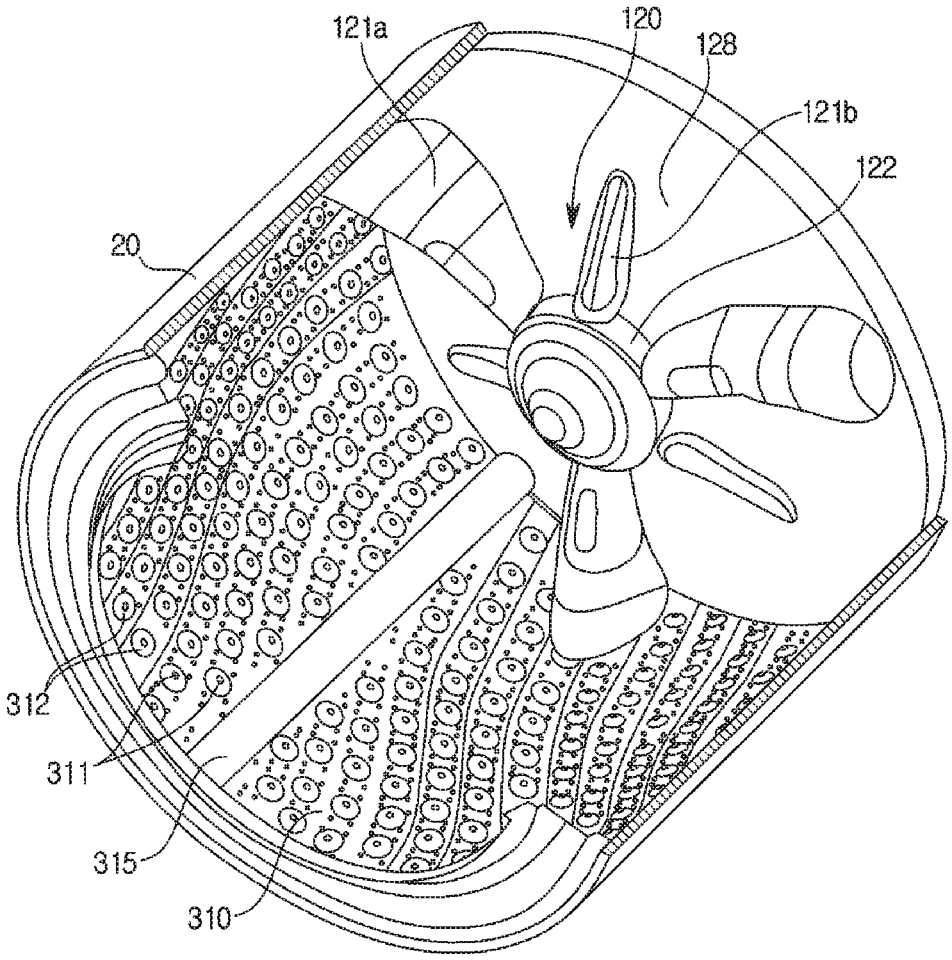
FIG. 7 is a view illustrating an inside of a tub, a drum, and a pulsator according to another embodiment of the present disclosure.

FIG. 7 is a view illustrating an inside of the tub 20, a drum 310, and the pulsator 120 according to another embodiment of the present disclosure.

The drum 310 according to the embodiment will be described with reference to FIG. 7. The same components as those in the embodiment shown in FIGS. 1 to 5 are denoted by the same reference numerals and the description thereof will not be repeated.

Referring to FIG. 7, the drum 310 according to the embodiment of the present disclosure may include an agitating protrusion 315 extending in the front and rear direction on the inner circumferential surface of the drum 310 and swollen toward the rotational axis of the drum 310 from the inner circumferential surface of the drum 310. The agitating protrusion 315 extends continuously from the front end to the rear end in the front-rear direction of the drum 310, as shown in FIG. 7, but the present disclosure is not limited thereto and the agitating protrusion 315 may be provided at a portion along the length direction of the drum 310.

Specifically, the through holes 311 formed in some parts of the inner circumferential surface of the drum 310 and the protrusions 312 forming the through holes 311 may be omitted, and the agitating protrusion 315 may be formed at the portion where the through holes 311 and the protrusions 312 are omitted. There may be three agitating protrusions 315 arranged along the inner circumferential surface of the drum 310 at regular intervals, but the number of the agitating protrusions 315 is not limited thereto.

Since the drum 310 according to the embodiment of the present disclosure includes the agitating protrusion 315, the laundry may be more effectively lifted and dropped.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A washing machine comprising:

a main body having a laundry inlet on a front surface portion of the main body;

a tub provided inside the main body to store washing water;

a drum rotatably provided in the tub;

a pulsator disposed inside the drum and configured to be rotated separately from the drum; and a driving device configured to provide power to the drum and the pulsator, the drive device comprising:

a first driving shaft connected to the drum and rotatably supported by a first bearing and a second bearing, the first bearing and the second bearing fixed to the tub, and a second driving shaft connected to the pulsator and rotatably supported by a first sleeve bearing fixed to an upper inner circumferential surface of the first driving shaft and a second sleeve bearing fixed to a lower inner circumferential surface of the first driving shaft, wherein no extra structure is mounted on an inner surface of the drum.

2. The washing machine of claim 1, wherein the drum comprises a plurality of through holes continuously formed along a circumferential surface thereof.

3. The washing machine of claim 1, wherein the drum and the pulsator have different rotating directions.

4. The washing machine of claim 1, wherein the driving device comprises:

an annular stator, a first rotor rotating inside the annular stator and connected to the first drive shaft, and a second rotor rotating outside the annular stator and connected to the second drive shaft.

* * * * *